US005854175A

United States Patent [19]

DeBoer et al.

[11] Patent Number: 5,854,175

[45] Date of Patent: Dec. 29, 1998

[54] EMBOSSED COMPACT DISC SURFACES FOR LASER THERMAL LABELING

[75] Inventors: Charles D. DeBoer, Palmyra; Xin Wen, Rochester; Lee W. Tutt, Webster, all of N.Y.

[73] Assignee: Eastman Kodak Company, Rochester, N.Y.

[21] Appl. No.: 833,749

[22] Filed: Apr. 9, 1997

[51] Int. Cl.[6] ..... B41M 5/035; B41M 5/38

[52] U.S. Cl. ..... 503/227; 428/172; 428/195; 428/913; 428/914; 430/945

[58] Field of Search ..... 8/471; 428/156, 428/172, 195, 913, 914; 430/945; 503/227

[56] References Cited

U.S. PATENT DOCUMENTS

| | | |
|---|---|---|
| 4,470,797 | 9/1984 | Harry et al. . |
| 4,695,286 | 9/1987 | Vanier et al. . |
| 4,775,657 | 10/1988 | Harrison et al. . |
| 4,962,081 | 10/1990 | Harrison et al. . |
| 4,973,572 | 11/1990 | DeBoer . |
| 5,171,650 | 12/1992 | Ellis et al. . |
| 5,244,861 | 9/1993 | Campbell et al. . |
| 5,317,337 | 5/1994 | Ewaldt . |
| 5,491,045 | 2/1996 | DeBoer et al. . |
| 5,542,768 | 8/1996 | Rother et al. . |
| 5,576,267 | 11/1996 | DeBoer et al. . |

OTHER PUBLICATIONS

"Graphic Arts Manual", edited by Janet and Irving Field, Arno/Musarts Press, New York, N.Y., 1980, pp. 416 to 418.

*Primary Examiner*—Bruce H. Hess
*Attorney, Agent, or Firm*—Raymond L. Owens

[57] ABSTRACT

A method for transferring colorant from a donor element to a dye receiving layer to form a desired label includes providing an embossed surface on the dye receiving layer having desired spacing to minimize mottling; positioning the embossed surface of the dye receiving layer in the focal plane of a focused laser beam with a colorant donor element being positioned in transferable relationship with the dye receiving element; and focusing a laser beam on the colorant donor element to heat the donor element to a sufficient temperature to transfer colorant to the dye receiving element to thereby effect the transfer of colorant from the donor element to the dye receiving layer. The method also includes providing relative movement between the dye receiving layer and the laser beam and modulating the laser beam in correspondence with a data record, thereby effecting laser thermal colorant transfer to the embossed surface on the dye receiving layer from the donor element in correspondence with a desired label so that the embossed spacing provides a high quality mottle free label.

14 Claims, 1 Drawing Sheet

EMBOSSED COMPACT DISC SURFACES FOR LASER THERMAL LABELING

CROSS REFERENCE TO RELATED APPLICATIONS

Reference is made to commonly assigned U.S. patent application Ser. No. 08/779,695, filed Jan. 7, 1997, entitled "Printing Onto Discs Such As Compact Discs and the Like", to Wen et al U.S. patent application Ser. No. 08/779,512, filed Jan. 7, 1997, entitled "Thermal Dye Transfer Printing of Compact Discs Labels", to Wen; and U.S. patent application Ser. No. 08/798,082, filed Feb. 12, 1997, entitled "Transferring Colorant From a Donor Element to a Compact Disc", to Wen et al, assigned to the assignee of the present invention. The disclosure of these related applications are incorporated herein by reference.

FIELD OF THE INVENTION

The present invention relates to label printing compact discs.

BACKGROUND OF THE INVENTION

A compact disc (CD) is a high-volume and long lived data-storage medium. One recordable compact disc (CD-R) contains a polycarbonate disc that is coated with a dye layer, a metallized reflective layer, and a protective layer. A CD-R will be understood to be a compact disc that can be written on, typically by a laser beam as contrasted with a CD-ROM which information is recorded by injection molding. Cyanine, phthalocyanine, and metallized azo dyes are commonly used dyes coated in a polymer binder in the dye layer. The metallized reflective layer typically consists of gold in CD-R, and aluminum in CD-ROM. In a CD writer, a laser beam illuminates the dye polymers through the polycarbonate substrate as the disc spins. The illumination is turned on and off at selective locations determined by the input digital information. The heating by the laser causes the dye layer to chemically change at these locations, forming readable marks in the dye polymer. The degraded dye polymers in the marked regions are less reflective than the unmarked regions. During the reading process, a low-power laser scans the dye polymer layer in a recorded disc. The laser light is reflected directly from the unmarked regions, but is scattered or diminished in the marked regions. A sensor monitors the transitions between the marked and unmarked regions from the intensity of the reflective light, and converts it into a digital data stream. Similar to the above process, a CD-ROM differentiates the intensity of the reflective light by pits and lands in the compact discs. These pits and lands are prerecorded by pressing the compact discs, typically mass produced.

The CDs are often coated with a printable surface opposite to the surface from which the information is recorded and retrieved. On the printable surface, a label is printed which can be logos, trademarks, text, graphics, and bar codes, etc., which are related to the information stored on the CD. The label also protects the CD from physical damage. Because the CD spins at high speed in the writer and the player, the CD label needs to be precisely balanced to the center of the disc for smooth rotation.

Labeling of CD discs has routinely been accomplished through screen printing methods. While this method can provide a wide variety of label content, it tends to be cost ineffective for run lengths less than 300–400 discs because the fixed cost on unique materials and set-up are shared by all the discs in each run. The screen printing technique is well described in the textbook "Graphic Arts Manual", edited by Janet and Irving Field, Arno/Musarts Press, New York, N.Y., 1980, pp. 416 to 418. In screen printing a stencil of the image is prepared, placed in contact with the CD and then ink is spread by squeegee across the stencil surface. Where there are openings in the stencil the ink passes through to the surface of the CD, thus producing the image. Preparation of the stencil is an elaborate, time consuming and expensive process.

Recently, significant increases in use of CD-R discs as a data distribution vehicle have increased the need to provide customized CD label content to reflect the data content of the disc. For these applications, the screen label printing presents a dilemma as CD-R discs are designed to allow customized user information to be recorded in standardized CD formats.

Initially, the customized label information was "hand written" on the disc surface using felt tipped markers. While this method allowed users to individually identify discs, it tends to be labor intensive, prone to human error in transcription, and aesthetically limited.

Other attempts to provide a CD-R labeling solution has incorporated digitally printed adhesive labels. Label stock for this type of CD-R labeling is available from a number of sources. These allow pre-cut labels to be printed using desktop or commercial ink-jet, thermal wax transfer, or electrophotographic printers. An example of such labels is the STOMP Company's (Irvine, Calif.) CD Stomper package of die-cut CD labels that can be printed on any 8.5 by 11 inch inkjet or laser printer. Following printing, the labels can be applied manually with or without the aid of an alignment tool or a specially designed machine. This method can be labor intensive. It is also prone to human error in label transfer. Damage to the CD-R can result if the label is removed. System performance problems can occur due to disc imbalance or label delamination in the CD writer or reader.

U.S. Pat. No. 5,317,337 describes an apparatus and method for printing label information on a CD. Both inkjet and laser printing are described, but the laser printing is limited to printing ink onto an intermediate drum and then transferring the image to the CD label, that is, offset printing Within the past several years, methods for direct CD labeling have been growing in prominence. These methods utilize the versatility and ease of the setup associated with digital printing to provide customized label content directly on a disc surface. The most commonly used direct CD printers incorporate inkjet or thermal wax transfer technologies. Examples of such printers are the AFFEX Corporation's (2522 Chambers Road, Suite 110, Tustin, Calif.) Multi Media Color Ink Jet Printer, the FARGO Corporation's (Eden Prairie, Minn.) Signature CD Color Printer. These printers can be either stand alone or integrated into a computerized disc writing system reducing problems associated with labor, human error, disc damage, and imbalance. While printers of this type can produce satisfactory output, specially designed layers are required for their use. There is concern over performance of printed image quality for both types of printers. Thermal printing has demonstrated a lack of robustness with respect to abrasion and ink jet printing is less resistant to moisture. There are additional concerns over the inability to produce multicolor output on the thermal wax transfer CD-label printers, and the long print time required for the ink jet label printing. Additionally, both of these printers are binary in the density scale, and cannot reproduce continuous tone photographic images.

One known continuous-tone digital color printing technique is the thermal resistive dye diffusion (or sublimation) printer. Printing techniques have been disclosed in U.S. Pat. No. 5,542,768, and the above cross referenced copending applications. However, a thermal resistive head (both thermal wax transfer and dye diffusion) prints at a pressure contact to the CD surface. Good printing uniformity by thermal resistive printing requires (see for example, U.S. Pat. No. 5,244,861) a conformable layer in the receiving paper, which is lacking in CD-R discs.

Screen printing is not economic for printing label images on a small number of disks. Inkjet and thermal wax transfer printing methods are binary, and therefore not suitable for photographic quality continuous tone printing. Thermal resistive head printing techniques including wax transfer and thermal dye diffusion printing require either a conformable surface or a high pressure nip contact between the print head and the Photo CD surface, both of which make the process expensive and difficult. All the above techniques, to different degrees, are slow in printing speeds.

Another way to print label images is described in cross referenced U.S. patent application Ser. No. 08/798,082, filed Feb. 12, 1997, entitled "Transferring Colorant From a Donor Element to a Compact Disc", to Wen et al. The problem with this method of printing is that spacer beads are required to be coated between the donor and receiver layers to prevent mottle. The spacers beads tend to be fugitive, and can contaminate the coating and printing process in a variety of ways. In addition, the spacer beads assume a random distribution during the coating process, and are extremely difficult to arrange in a more optimum pattern.

It would be desirable if the gap between the donor and receiver in thermal dye transfer printing to a compact disc could be controlled without recourse to spacer beads.

SUMMARY OF THE INVENTION

The object of this invention is to provide an improved mottle free high quality label which is particularly suitable for use on CDs.

This object is achieved by a method for transferring colorant from a donor element to a dye receiving layer to form a desired label, comprising the steps of:

a) providing an embossed surface on the dye receiving layer having desired spacing to minimize mottling;

b) positioning the embossed surface of the dye receiving layer in the focal plane of a focused laser beam with a colorant donor element being positioned in transferable relationship with the dye receiving element;

c) focusing a laser beam on the colorant donor element to heat the donor element to a sufficient temperature to transfer colorant to the dye receiving element to thereby effect the transfer of colorant from the donor element to the dye receiving layer; and d) providing relative movement between the dye receiving layer and the laser beam and modulating the laser beam in correspondence with a data record, thereby effecting laser thermal colorant transfer to the embossed surface on the dye receiving layer from the donor element in correspondence with a desired label so that the embossed spacing provides a high quality mottle free label.

ADVANTAGES

By using an embossed dye image receiving layer, the present invention provides high quality labels without the need for coating bead spacers which may flake off and contaminate the media.

Another advantage of the invention is that the spacer elements can be placed at exactly optimum positions and do not depend on random placement that is required for spacer beads.

Yet another advantage of the invention is that the spacer elements can be of carefully controlled size and shape.

The terms "spacer element", "embossment", and "protrusion", are used throughout this specification will be understood to those skilled in the art to be essentially synonymous. Furthermore, it will be understood that the area of the protrusions will generally be limited to less than half the total area, and the height of a protrusion will be the difference between the average height of the peaks compared to the average height of the surrounding area.

DETAILED DESCRIPTION OF THE INVENTION

Figure 1:
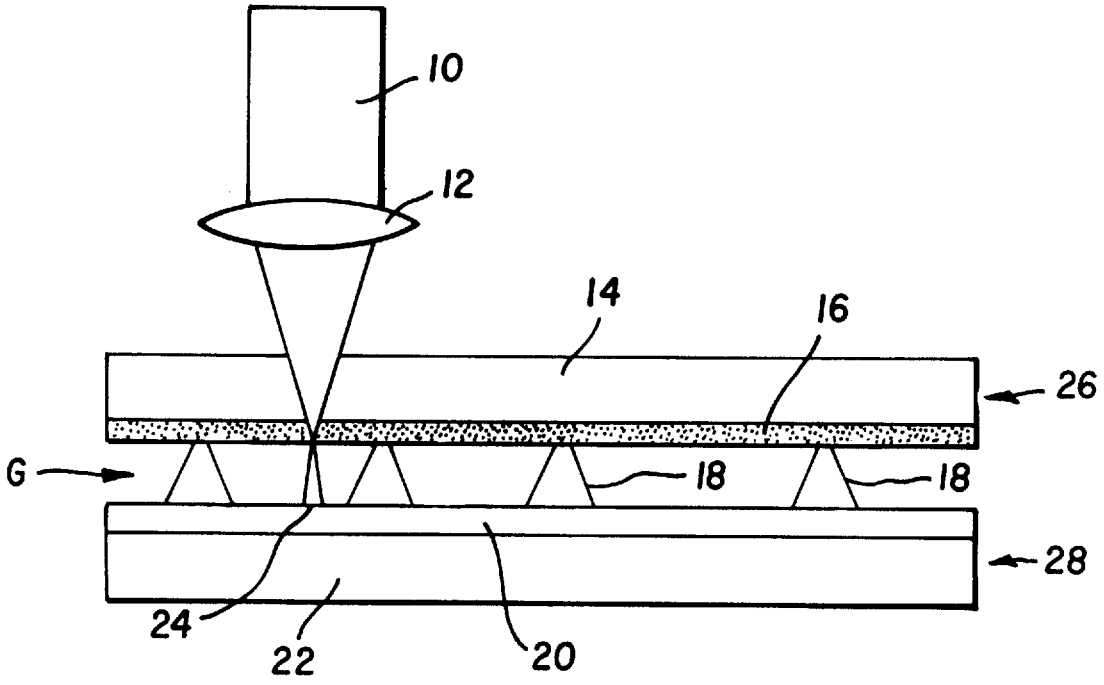
FIG. 1 is a partial schematic view showing an apparatus for printing label information on compact discs by infrared laser thermal transfer wherein the compact disc is in transferable relationship with a colorant donor element

The present invention is described with relation to a compact disc which can include a CD-ROM and a CD-R, it will be understood that it also can be directly applied to newer forms of discs such as those called digital versatile discs or DVD. So when the term CD is used, it will be understood to include all of these types of discs. The term "label" as used throughout this specification will be understood to those skilled in the art to include digital data such as bar codes, analog data such as text, graphics such as line art, pictorial information such as colored images or combinations thereof and the like.

Referring to FIG. 1, a diode laser beam 10 is shown being focused by a lens 12 through a transparent donor element support 14 onto a color layer 16 which contains a) an absorber for the laser beam to generate heat; b) a colorant to transfer to the dye receiving layer 20 which is coated on the disc substrate 22 to produce a colored pixel of the desired image 24; c) a polymeric binder to hold the colorant in the layer. The heat generated by the absorption of the laser beam causes the colorant to evaporate, sublime, or ablatively transfer (24) from the donor element layer to the disc 28. Between the donor element and the disc are deposed protrusions 18 to maintain a fixed gap "g" between the donor element 26 and the dye receiving layer 20.

The size and placement of the protrusions 18 is determined by the appearance of the printed label. Elimination of the protrusions 18 leads to an extremely mottled and non-uniform printed image, because some areas of contact may cause the hot donor layer to bond to the receiver layer like hot melt glue, leading to high density defects. Other areas of contact may lead to overly rapid cooling of the hot donor layer, leading to areas of low density. The result is extreme mottle. On the other hand, protrusions 18 which are too high give blurry images, because of the spread of the dye as it travels from the donor to the disc. The shape of the protrusions 18 may also be important. A wide flat protrusion 18, similar to a mesa, may provide areas of contact, and therefore of mottle, which are large enough to be visible in the final image. On the other extreme, an protrusion 18 which is too pointed, like a needle, may lack strength, and be broken off during the printing operation. The number of protrusions 18 is also important. Too few protrusions 18 may allow the donor to sag and touch the receiver in-between contact points. Too many protrusions 18 may become visible to the naked eye. Placement of the protrusions 18 may be important. An extremely regular pattern of artifacts such as these protrusions 18 may sometimes sensitize the eye, and become more visible than desired. On the other hand, a completely random pattern may place some of the protrusions 18 too close together thereby making the combination of two sub-visible protrusions 18 visible to the eye. In a preferred embodiment of the invention, the height of the protrusions 18 are from 3 to 20 microns, with at least 1 protrusions 18 per square mm but no more than 1000 protrusions 18 per square mm, with a height to width ratio of at least 1 to 1 but no more than 10 to 1, and with a placement pattern wherein no two protrusions 18 are closer than 25% of their average spacing. Alternatively, the number of protrusions can be in a range of from 1 to 100 protrusions per square mm.

The surface of the dye receiving layer 20 can be embossed by several methods. By use of the term "embossed surface" is meant there are areas which protrude above indentations or lower areas. The protrusions are actually formed as indentations in a mold so that areas which protrude, or have an average height greater than the average height of the surround areas. In a preferred embodiment of the invention the protrusions are formed during the injection molding process to make a disc. Indentations in the surface of the mold, when filled with the molten polymer which comprises the substrate, become the protrusions of the formed disc.

After a first color is printed, the donor element is removed without disturbing the position of the disc, the second color donor element is placed in position, and the printing process is repeated with the second digital color record. Generally three color donor elements are required for a full color image; cyan, magenta and yellow, corresponding to the red, green and blue color separations of the digital image. The terms "dye", "pigment", and "colorant" as used throughout this specification will be understood to those skilled in the art to be essentially synonymous and interchangeable.

The colorants in the color layer can be chosen from a number of dyes or pigments. It is important that the colorant have a clean, strong hue, with good color saturation and little unwanted absorption in the optical region of the electromagnetic spectrum. The colorant should also have a low thermal mass, so the minimum amount of heating is required to cause the colorant to transfer from the donor element to the receiver. Throughout this specification, whenever the term "thermal mass" is used, it will be understood to mean the weight, or mass, of material that will be raised a given temperature by a given amount of energy (a given number of Joules). Exemplary dyes that can be use can be found in commonly assigned U.S. Pat. No. 5,576,267 to DeBoer et al, the disclosure of which is hereby incorporated by reference.

The polymeric binder for the colorant can be chosen from the common film forming thermoplastic polymers, such as cellulose acetate, cellulose acetate propionate, polyvinylbutyral, nitrocellulose, and the like. Exemplary binder polymers can be found in U.S. Pat. No. 5,491,045, the disclosure of which is hereby incorporated by reference.

The polymeric dye receiving layer 20 on the disc can be chosen from a number of film forming polymers such as polycarbonates, polyesters, and polyacrylates, for example. Exemplary polymers can be found in U.S. Pat. Nos. 4,695,286; 4,470,797; 4,775,657; and 4,962,081, the disclosure of which is hereby incorporated by reference. The purpose of the dye receiving layer is to hold the dye in a fixed location, so the image cannot smear or migrate. In addition, the dye receiving layer imparts the correct hue to the colorant. The dye receiving layer may contain brightening agents, opacification agents, and the like.

The infrared absorber can be a dye, pigment, or metal in a separate layer as disclosed in U.S. Pat. No. 5,171,650, the disclosure of which is hereby incorporated by reference.. Ideally, the absorber should have high absorption for a given thermal mass, and should not transfer to the receiver in any significant way that might contaminate the colors of the image. Exemplary dyes that can be used as absorbers can be found in U.S. Pat. No. 4,973,572, the disclosure of which is hereby incorporated by reference.

The laser beam can be focused to approximately the same size as the wavelength of light emitted by the laser. For a near infra-red laser this is a spot size of about one micron. This small size assures that a high quality photographic image can be printed. Modulation of the intensity of the beam allows many levels of color, from very light to very dark, to be printed at any given pixel of the image.

The invention has been described in detail with particular reference to certain preferred embodiments thereof, but it will be understood that variations and modifications can be effected within the spirit and scope of the invention. For example, it will be understood that the embossment technique described in this invention can also be applied to the surface of the color layer of the donor element.

PARTS LIST

10 beam
12 F-theta lens
14 donor element support
16 color layer
18 spacer protrusions 18
20 dye receiving layer
22 disc substrate
24 transferred color pixel
26 donor element
28 disc

What is claimed is:

1. A method for transferring colorant from a donor element to a dye receiving layer to form a desired label, comprising the steps of:

a) providing an embossed surface on the dye receiving layer having desired spacing to minimize mottling;

b) positioning the embossed surface of the dye receiving layer in the focal plane of a focused laser beam with a colorant donor element being positioned in transferable relationship with the dye receiving element;

c) focusing a laser beam on the colorant donor element to heat the donor element to a sufficient temperature to transfer colorant to the dye receiving element to thereby effect the transfer of colorant from the donor element to the dye receiving layer; and d) providing relative movement between the dye receiving layer and the laser beam and modulating the laser beam in correspondence with a data record, thereby effecting laser thermal colorant transfer to the embossed surface on the dye receiving layer from the donor element in correspondence with a desired label so that the embossed spacing provides a high quality mottle free label.

2. The method of claim 1 wherein the embossed surface includes protrusions and indentations above and below such embossed surface, respectively, and are in a range of from 3 to 20 microns.

3. A method for transferring colorant from a donor element having a colorant layer with transferable colorant and a layer for absorbing infrared laser light to heat the colorant so as to transfer colorant to a dye receiving layer to form a desired label comprising the steps of:

a) providing an embossed surface on the dye receiving layer having desired spacing to minimize mottling;

b) positioning the embossed surface of the dye receiving layer in the focal plane of a focused laser beam with a colorant donor element being positioned in transferable relationship with the dye receiving layer;

c) focusing an infrared laser beam on the colorant donor element to cause the absorbing layer to heat the donor element to a sufficient temperature to transfer colorant to the dye receiving layer to thereby effect the transfer of colorant from the donor element to the dye receiving element; and d) providing relative movement between the dye receiving layer and the laser beam and modulating the laser beam in correspondence with a label to thereby effecting laser thermal colorant transfer to thereby effecting laser thermal colorant transfer to the embossed surface on the dye receiving layer from the donor element in correspondence with the desired label so that the embossed spacing provides a high quality mottle free label.

4. The method of claim 1 wherein the embossed surface is formed by mechanically embossing the surface of the dye receiving element.

5. The method of claim 3 wherein the dye receiving layer is a polymer image receiving layer.

6. The method of claim 5 further including positioning different donor elements, each with a different colorant in image transferable relationship with the dye receiving element to provide a color image.

7. The method of claim 5 wherein the colorant is a dye which is adapted to be transferred by sublimation to the image receiving layer.

8. The method of claim 5 wherein the embossed surface includes spacer elements.

9. The method of claim 5 wherein the embossed surface is provided by forming a mold with indentations corresponding to the protrusions of the embossed surface and where the mold engages the top surface of the dye receiving layer to form the embossed surface.

10. The method of claim 9 wherein the height of the protrusions is in a range from 3 microns to 20 microns and there are from 1 to 1000 protrusions per square mm.

11. The method of claim 10 wherein there are from 1 to 100 protrusions per square mm.

12. The method of claim 10 wherein the protrusions are irregularly spaced.

13. The method of claim 9 wherein the protrusions regularly and evenly spaced.

14. The method of claim 1, wherein the dye receiving element is disposed on a compact disc (CD).

* * * * *